US005639717A

United States Patent [19]

Berlowitz et al.

[11] Patent Number: 5,639,717

[45] Date of Patent: Jun. 17, 1997

[54] ADDITIVE COMBINATION TO REDUCE DEPOSIT FORMING TENDENCIES AND IMPROVE ANTIOXIDANCY OF AVIATION TURBINE OILS (LAW328)

[75] Inventors: Paul Joseph Berlowitz, East Windsor; Morton Beltzer, Westfield, both of N.J.; Thomas Lee Ashcraft, Leander, Tex.

[73] Assignee: Exxon Research & Engineering Company, Florham Park, N.J.

[21] Appl. No.: 678,911

[22] Filed: Jul. 12, 1996

[51] Int. Cl.[6] ..... C10M 133/42

[52] U.S. Cl. ..... 508/257

[58] Field of Search ..... 508/257

[56] References Cited

U.S. PATENT DOCUMENTS

| | | | |
|---|---|---|---|
| 3,706,740 | 12/1972 | Dexter et al. | 508/257 |
| 3,723,317 | 3/1973 | Ulery | 508/257 |
| 3,849,319 | 11/1974 | Nebzydoski | 508/257 |
| 4,931,196 | 6/1990 | Payne et al. | 508/257 |
| 5,275,745 | 1/1994 | Habeeb et al. | 508/257 |
| 5,389,272 | 2/1995 | Beltzer et al. | 508/257 |

*Primary Examiner*—Jacqueline V. Howard
*Attorney, Agent, or Firm*—Joseph J. Allocca

[57] ABSTRACT

An aviation turbine oil of reduced deposit forming tendencies and improved anti oxidancy is disclosed which comprises a major portion of a suitable aviation turbine oil base stock and a minor amount of a non-sulfur containing triazine derivative and trithiocyanuric acid, its substituted derivatives and mixture of such trithiocyanuric acid and its derivatives.

11 Claims, No Drawings

ADDITIVE COMBINATION TO REDUCE DEPOSIT FORMING TENDENCIES AND IMPROVE ANTIOXIDANCY OF AVIATION TURBINE OILS (LAW328)

BACKGROUND OF THE INVENTION

1. Field of the Invention

This invention relates to ester based, in particular diester and polyol ester-based turbo oils which exhibit superior antioxidancy and reduced deposit forming tendencies. More particularly it related to turbo oils comprising esters of pentaerythritol with fatty acids as basestock, and containing a combination of additives which impart improved antioxidancy and reduced deposit formation.

2. Description of the Related Art

Organic compositions such as mineral oils and lubricating compositions are subject to deterioration by oxidation and in particular are subject to such deterioration at high temperatures in the presence of air. This deterioration often leads to buildup of insoluble deposits which can foul engine parts, deteriorate performance, and increase maintenance. This is particularly the case for lubricating oils used in jet aircraft where wide temperature ranges and extreme operating conditions are likely to be encountered. Proper lubrication of aircraft gas turbines, for example, requires the ability to function at bulk oil temperatures as low as –65° F. to as high as 450°–500° F.

Most lubricants contain additives to inhibit their oxidation. For example, U.S. Pat. No. 3,773,665 discloses a lubricant composition containing an antioxidant additive mixture of dioctyl diphenylamine and a substituted naphthylamine. U.S. Pat. Nos. 3,759,996; 3,573,206; 3,492,233, and U.S. Pat. No. 3,509,214 disclose various methods of oxidatively coupling alkylated diphenylamines with substituted naphthylamines.

Patents disclosing the use of tri-substituted triazines in lubricants generally demonstrate the antioxidant function of these molecules when either used alone, or in combination with other antioxidants. They do not describe the use of these materials as anti-deposition additives. U.S. Pat. No. 3,250,708 describes the use of several triazine derivatives, and combinations with hydroxyl aromatic co-antioxidants. U.S. Pat. No. 3,278,436 and U.S. Pat. No. 3,322,763 describes tri-substituted triazines including piperidinyl bridged triazines in combination with hydroxyl aromatics.

European Patent application 002,269 discloses the use of tri-substituted triazines where at least one of the amino substituents contains at least one hydrogen as antioxidants, and in combination with arylamine antioxidants.

U.S. Pat. No. 3,642,630 discloses that the use of symmetrical and asymmetrical substituted triazines with N-substituted phenothiazine imparts good oxidation stability to synthetic ester based lubricants over a wide range of temperatures.

Other triazine derivatives disclosed in a number of patents to stabilize oils would not be suitable for use in aviation turbine oils as these derivatives contain halogens which are corrosive to metals. For example, U.S. Pat. No. 3, 198,797 utilizes 2,4-dichloro-6-dialkyl-dyhydroxy-anilino-1,3,5 triazines. Similarly, U.S. Pat. No. 3,202,681 utilizes monohalogen substituted triazines, especially monochloro substituted ones.

It has now been discovered that the deposit forming tendencies and antioxidant properties of these basic antioxidant systems, e.g., tri-substituted triazines alone or in combination with arylamines, can be greatly enhanced by the addition of a small amount of a non-antioxidant, sulfur containing additive, specifically trithiocyanuric acid.

SUMMARY OF THE INVENTION

The present invention resides in a turbo oil composition exhibiting enhanced antioxidancy and resistance to deposit formation, and to a method for achieving that result in turbo oils.

The gas turbine lubricating oil of the present invention comprises a major proportion of synthetic ester based base stock including diesters and polyol esters, preferably polyol ester based base stock and a minor proportion of an antioxidant/deposit control additive comprising a non-sulfur containing, triazine derivative antioxidant and trithiocyanuric acid or its substituted derivatives. Other, conventional additives such as extreme pressure, pour point reduction, oxidative stability, anti-foaming, hydrolytic stability, improved viscosity index performance, anti-wear, and corrosion inhibitor additives and others may also be employed.

Improved oxidation and deposit control performance in turbo lube oils is achieved by adding to the synthetic polyol ester based lubricating oil an additive package containing a mixture of a non-sulfur containing triazine antioxidant and trithiocyanuric acid.

The non-sulfur containing triazine antioxidant is used in an amount in the range 0.1 to 1.2 percent by weight, preferably 0.2 to 0.9 percent, most preferably 0.4 to 0.7 percent, while the trithiocyanuric acid is used in an amount in the range 50 to 1000 ppm, preferably 100 to 600 ppm, most preferably 200–400 ppm.

The non-sulfur containing triazine antioxidant and trithiocyanuric acid or their substituted derivatives are used in a ratio in the range of 2:1 to 100:1, preferably 10:1 to 40:1, most preferably 15:1 to 25:1

The use of a non-sulfur containing triazine antioxidant and trithiocyanuric acid mixture produces a turbo oil exhibiting markedly superior oxidation and deposit control properties performance as compared to the performance exhibited without the combination.

DETAILED DESCRIPTION

A turbo oil having unexpectedly superior deposition performance comprises a major portion of a synthetic ester base oil and minor portion of an anti-deposition additive package comprising of a mixture of a non-sulfur containing substituted triazine derivative with trithiocyanuric acid. Synthetic esters include diesters and polyol esters.

The diesters that can be used for the improved deposition turbo oil the present invention are formed by esterification of linear or branched $C_6$–$C_{15}$ aliphatic alcohols with one of such dibasic acids as adipic, sebacic or azelaic acids. Examples of diesters are di-2-ethylhexyl sebacate and dioctyl adipate.

The synthetic polyol ester base oil is formed by the esterification of an aliphatic polyol with carboxylic acid. The aliphatic polyol contains from 4 to 15 carbon atoms and has from 2 to 8 esterifiable hydroxyl groups. Examples of polyol are trimethylolpropane, pentaerythritol, dipentaerythritol, neopentyl glycol, tripentaerythritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the structural formula

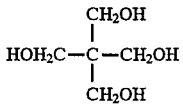

I and about 12% of dipentaerythritol having the formula

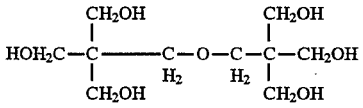

II

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the polyol ester base stock is added a minor portion of an additive mixture comprising a non-sulfur containing triazine derivative antioxidant and trithiocyanuric acid or its substituted derivative.

The non-sulfur containing triazine derivatives are preferably those of the form:

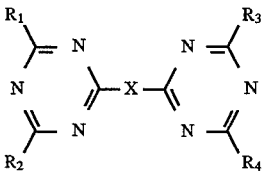

III or alternatively, compound III may also be of the form:

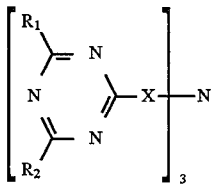

IIIa where $R_1$, $R_2$, $R_3$, $R_4$ are the same or different and are

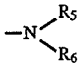

wherein $R_5$ and $R_6$ are the same or different and are selected from the group consisting of $C_2$ to $C_{16}$ branched or straight chain alkyl, aryl-$R_7$ where $R_7$ is branched or straight chain $C_2$ to $C_{16}$ alkyl, cyclohexyl-$R_7$ where $R_7$ is H or branched or straight chain $C_2$ to $C_{16}$ alkyl or mixtures thereof. Preferably $R_1$, $R_2$, $R_3$, and $R_4$ are the same or different and are all dialkyl amino groups where the alkyl chains are $C_4$ to $C_{12}$and mixtures thereof.

For compound III, X is a bridging group which is selected from the group consisting of piperidino, hydroquinone, or NH—$R_8$—NH and mixtures thereof where $R_8$ is $C_1$ to $C_{12}$branched or straight chain alkyl and mixtures thereof.

For compound IIIa X is selected from the group consisting of piperidino, hydroquinone, and NH—$R_8$ and mixtures thereof where $R_8$ is $C_1$ to $C_{12}$ branched or straight chain alkyl and mixtures thereo.

The triazine derivative may also be of the form:

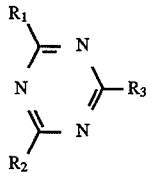

IV where $R_1$, $R_2$, and $R_3$ are identical to the description above. The preferred non-sulfur containing triazines are those of the formula III and IIIa. Those of formula IV are less preferred due to their lower molecular weight which leads to higher volatility and lower suitability for high-temperature synthetic oil use.

The non-sulfur containing triazine antioxidant is used in an amount in the range 0.1 to 1.2 percent by weight (based on base stock), preferably 0.2 to 0.9 percent, most preferably 0.4 to 0.7 percent, Trithiocyanuric acid and its substituted derivatives are represented by the structural formula:

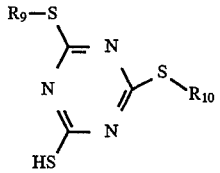

V where $R_9$ and $R_{10}$ are the same or different and are H or $C_1$ to $C_{12}$ branched or straight chain alkyl. Preferably $R_9$ and $R_{10}$ are H (unsubstituted trithiocyanuric acid).

The trithiocyanuric acid or its substituted derivative or mixtures thereof is used in an amount in the range 50 to 1000 ppm by weight (based on polyol ester base stock), preferably 100 to 600 ppm, most preferably 200–400 ppm.

The non-sulfur containing triazine antioxidant and trithiocyanuric acid and/or their substituted derivatives are used in a ratio in the range of 2:1 to 100:1, preferably 10:1 to 40:1, most preferably 15:1 to 25:1.

The reduced-deposit oil preferably synthetic polyol ester based reduced-deposit oil may also contain one or more of the following classes of additives: antifoamants, antiwear agents, corrosion inhibitors, hydrolytic stabilizers, metal deactivator, detergents and additional antioxidants. Total amount of such other additives can be in the range 0.5 to 15 wt %, preferably 2 to 10 wt %, most preferably 3 to 8 wt %.

Antioxidants which can be used include aryl amines, e.g., phenylnaphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an mount in the range 0.5 to 4 wt %, preferably 1 to 3 wt %.

Corrosion inhibitors include but are not limited to various triazols, e.g., tolyl triazole, 1,2,4 benzyltriazole, 1,2,3 benzyltriazole, carboxy benzotriazole, alkylated benzotriazole and organic diacids, e.g., sebacic acid.

The corrosion inhibitors can be used in an amount in the range 0.02 to 0.5 wt %, preferably 0.05% to 0.25 wt %.

As previously indicated, other additives can also be employed including hydrolyric stabilizers, pour point depressants, anti-foaming agents, viscosity and viscosity index improvers, etc.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pages 1–11, the disclosures of which are incorporated herein by reference.

The additive combinations are useful in ester fluids including lubricating oils, particularly those ester fluids useful in high temperature avionic (turbine engine oils) applications. The additive combinations of the present invention exhibit excellent deposit inhibiting performance and improved oxidative stability as measured in the Inclined Panel Deposition Test.

The present invention is further described by reference to the following non-limiting examples.

EXAMPLE 1

This example illustrates the deposit formation performance for the most preferred embodiment of the invention by evaluating fully formulated oils in the Inclined Panel Deposit Test ("IPDT"). The additives tested were blended into a finished turbo oil formulation suitable for applications covered by the MIL-23699 specifications by using a constant package of additives and basestock. The basestock was a technical pentaerithritol ester made using an acid mixture of $C_5$ to $C_{10}$ commercially available acids. The additive package contained diaryl amine antioxidants, a commonly used metal passivator containing triaryl phosphates, a corrosion inhibitor consisting of alkylated benzotriazole, and a hydrolyric stabilizer. The total concentration of these other additives was 5.74 gms/100 gms polyol ester base stock.

The IPDT is a bench test consisting of a stainless steel panel electrically heated by means of two heaters inserted into holes in the panel body. The test temperature is held at 310° C. The panel temperature is monitored using a recording thermocouple. The panel is inclined at a 4° angle and oil is dropped onto the heated panel near the top, allowing the oil to flow the length of the panel surface, drip from the end of the heated surface and be recycled to the oil reservoir. The oil forms a thin moving film which is in contact with air flowing through the test chamber. Test duration is 24 hours. Deposits formed on the panel are rated on a scale identical to that used for deposits formed in the bearing rig test (FED. Test Method STD. No. 791C, Method 3410.1). Varnish deposits rate from 0 (clean metal) to 5 (heavy varnish). Sludge deposits rate from 6 (light) to 8 (heavy). Carbon deposits rate from 9 (light carbon) to 11 (heavy/thick carbon). Higher ratings (12 to 20) are given to carbon deposits that crinkle or flake away from the metal surface during the test. The total weight of the deposit formed in 24 hours is also measured. In addition, the final viscosity, measured at 40° C., and Total Acid Number ("TAN"), expressed as mg KOH/100 ml, of the used oil are measured after the test is complete, and used as an evaluation of the oxidation of the oil.

Table 1 illustrates the deposition synergistic effect between unsubstituted trithiocyanuric acid, "TTCU", (compound V, where $R_9$ and $R_{10}$ are H) and "Triazine", (compound III, where $R_1$, $R_2$, $R_3$, and $R_4$ are all dibutylamino and X is piperidino). The results with either the TTCU or Triazine alone show essentially no differences from the base formulated oil; only the addition of both materials significantly improves the result.

TABLE 1

| TTCU Concentration | Triazine Concentration | Deposit Rating | Deposit Weight |
|---|---|---|---|
| 0.00% | 0.00% | 4.0 | 0.18 gms |
| 0.03% | 0.00% | 3.7 | 0.20 gms |
| 0.00% | 0.60% | 3.9 | 0.18 gms |
| 0.03% | 0.60% | 2.1 | 0.01 gms |

Table 2 illustrates the oxidative synergisms for the same compounds in the same test by measuring the percent increase in viscosity and the increase in TAN. Neither additive alone improves the oxidative degradation substantially over the base formulation, but the present invention (combination of TTCU and Triazine) yields essentially no increase in viscosity and little increase in TAN indicating a formulation which has not been significantly oxidized.

TABLE 2

| TTCU Concentration | Triazine Concentration | Vis Increase, % | TAN Increase |
|---|---|---|---|
| 0.00% | 0.00% | 93 | 13.8 |
| 0.03% | 0.00% | 97 | 16.3 |
| 0.00% | 0.60% | 89 | 13 |
| 0.03% | 4.60% | −4 | 1.3 |

EXAMPLE 2

This example shows the results obtained when variations in the amounts of the two subject additives used in Example 1 are employed, in the same base formulation as Example 1, in the IPDT test. In each case results are substantially better than the base formulation, but not as good as the results in the preferred TTCU and Triazine concentration formulation of Example 1.

Table 3 shows a series of additive treatments in the same base formulation as Example 1 and the Deposition measures, Rating and Deposit Weight, from the IPDT. Table 4 shows oxidation measures from the IPDT, Viscosity increase and TAN increase, for the identical formulations in the same tests.

TABLE 3

| TTCU Concentration | Triazine Concentration | Deposit Rating | Deposit Weight |
|---|---|---|---|
| 0.00% | 0.00% | 4.0 | 0.18 gms |
| 0.03% | 0.50% | 3.3 | 0.03 gms |

TABLE 3-continued

| TTCU Concentration | Triazine Concentration | Deposit Rating | Deposit Weight |
|---|---|---|---|
| 0.01% | 0.60% | 4.1 | 0.10 gms |
| 0.02% | 0.60% | 4.3 | 0.07 gms |
| 0.02% | 0.75% | 3.8 | 0.05 gms |

While deposit ratings are not substantially changed in some of the cases in Table 3, overall deposit weight is reduced by 44% to 83% for these additive treatments.

ester made with an acid mixture of $C_5$ to $C_{10}$ commercially available acids which was different from that used in Example 1. The additive package contained diaryl amine antioxidants, a commonly used metal passivator containing triaryl phosphates, a corrosion inhibitor consisting of alkylated benzotriazole, and a hydrolytic stabilizer. In this example the total concentration of these other additives was 4.74 grams per 100 grams of polyolester base stock.

In this example, the IPDT test was run at 299° C.

The Triazine derivatives used are represented by structural formula VI and VII below:

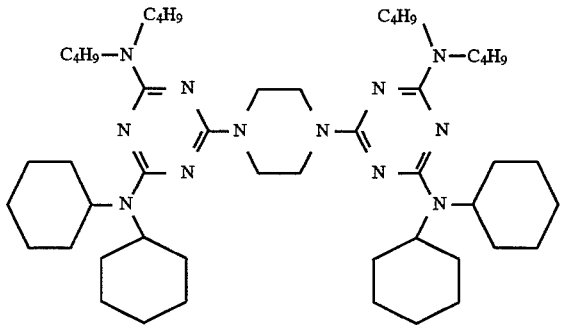

VI

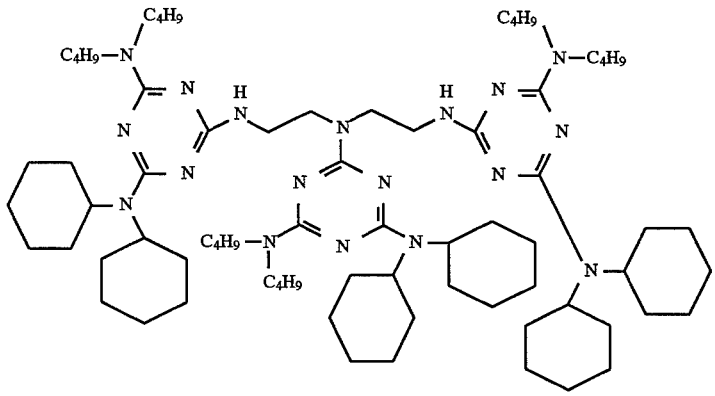

VII

TABLE 4

| TTCU Concentration | Triazine Concentration | Vis Increase, % | TAN Increase |
|---|---|---|---|
| 0.00% | 0.00% | 93 | 13.8 |
| 0.03% | 0.50% | 5 | 2.2 |
| 0.01% | 0.60% | 44 | 8.8 |
| 0.02% | 0.60% | 3 | 2.9 |
| 0.02% | 0.75% | 26 | 3.7 |

In each case in Table 4 the Viscosity increase is lower and the TAN increase is much lower.

EXAMPLE 3

This example illustrates the use of other triazine derivatives in synergistic combinations with trithiocyanuric acid to reduce deposition and improve oxidative stability. A different base formulation was used from Examples 1 and 2. The base formulation was a finished turbo oil formulation suitable for applications covered by the MIL-23699 specifications formulated by using a constant package of additives and basestock. The basestock was a technical pentaerithritol Table 5 shows the effect of the use of triazine derivatives VI and VII in combination with trithiocyanuric acid, on the deposition formation performance of the formulation as measured in the IPDT. In contrast to this is shown the performance when compound VIII is used (compound VIII is material of structural formula IV where $R_1$, $R_2$, and $R_3$ are all dibutylamino). This compound, with higher volatility, exhibits worse deposition properties.

TABLE 5

| Triazine Compound | TTCU Concentration | Triazine Concentration | Deposit Rating | Deposit Weight |
|---|---|---|---|---|
| VI | 0.00% | 0.6% | 3.3 | 0.22 gm |
| VI | 0.03% | 0.6% | 1.8 | 0.03 gm |
| VII | 0.00% | 0.6% | 4.2 | 0.27 gm |
| VII | 0.03% | 0.6% | 2.1 | 0.07 gm |
| VIII | 0.03% | 0.6% | 3.5 | 0.12 gm |

Deposit ratings and weights are substantially reduced for compounds VI and VII, but only slightly for compound VIII. Table 6 below shows that these compounds also improve the oxidative stability of this oil when used in combination with TTCU as measured by the IPDT.

TABLE 6

| Triazine Compound | TTCU Concentration | Triazine Concentration | Vis Increase, % | TAN Increase |
|---|---|---|---|---|
| VI | 0.00% | 0.6% | 160 | 12.8 |
| VI | 0.03% | 0.6% | 3 | 0.9 |
| VII | 0.00% | 0.6% | 157 | 6.5 |
| VII | 0.03% | 0.6% | 4 | 1.1 |
| VIII | 0.03% | 0.6% | 36 | 7.9 |

What is claimed is:

1. A turbo oil composition exhibiting enhanced resistance to deposition and improved oxidative stability, said turbo oil formulation comprising a major portion of a synthetic ester based base stock and a minor portion of an additive comprising a mixture of a non-sulfur containing substituted triazine antioxidant and a trithiocyanuric acid.

2. The turbo oil composition of claim 1 wherein non-sulfur containing triazine antioxidant is added in an amount in the range 0.1 to 1.2 percent by weight, preferably 0.2 to 0.9 percent, most preferably 0.4 to 0.7 percent, while the trithiocyanuric acid is added in an amount in the range 50 to 1000 ppm.

3. The turbo oil composition of claim 1 wherein the synthetic ester based base stock is the esterification product of an aliphatic polyol containing 4 to 15 carbon atoms and from 2 to 8 esterifiable hydroxyl groups reacted with a carboxylic acid containing from 4 to 12 carbon atoms.

4. The turbo oil composition of claim 3 wherein the synthetic ester based base stock is the esterification product of technical pentaerythritol and a mixture of $C_4$ to $C_{12}$carboxylic acids.

5. The turbo oil composition of claim 1 wherein the non-sulfur containing triazine antioxidant and trithiocyanuric acid are added in a ratio in the range of 2:1 to 100:1.

6. The turbo oil composition of claims 1, 2, 3, 4 or 5 where the substituted triazine is of the structural formula:

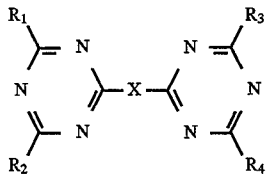

III or of the structural formula:

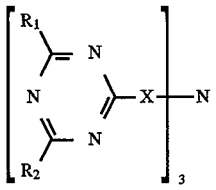

IIIa where $R_1$, $R_2$, $R_3$, $R_4$ are the same or different and are

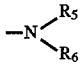

wherein $R_5$ and $R_6$ are the same or different and are selected from the group consisting of $C_2$ to $C_{16}$ branched or straight chain alkyl, aryl-$R_7$ where $R_7$ is branched or straight chain $C_2$ to $C_{16}$ alkyl, cyclohexyl-$R_7$ where $R_7$ is H or branched or straight chain $C_2$ to $C_{16}$ alkyl, and mixtures thereof and wherein in formula III X is a bridging group selected from the group consisting of piperidino, hydroquinone, NH—$R_8$—NH and mixtures thereof where $R_8$ is $C_1$ to $C_{12}$ branched or straight chain alkyl, and in formula IIIa X is selected from the group consisting of piperidino, hydroquinone, NH—$R_8$ and mixtures thereof where $R_8$ is $C_1$ to $C_{12}$ branched or straight chain alkyl and mixtures thereof.

7. The turbo oil composition of claims 6 where the substituted triazine is of the structural formula:

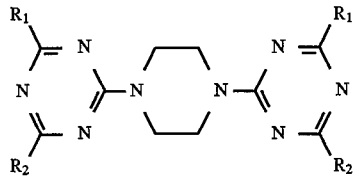

where $R_1$ is dibutylamino, and $R_2$ is dibutylamino or dicyclohexylamino.

8. The turbo oil composition of claims 1, 2, 3, 4, or 5, wherein the substituted trithiocyanuric acid is of the structural formula:

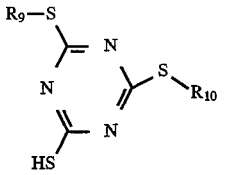

where $R_9$ and $R_{10}$ are the same or different and are selected from H or $C_1$ to $C_{12}$ branched or straight chain alkyl and mixtures thereof.

9. The turbo oil of claim 8 wherein $R_9$ and $R_{10}$ groups on the trithiocyanuric acid are both H.

10. The turbo oil composition of claim 6 wherein the substituted trithiocyanuric acid is of the structural formula:

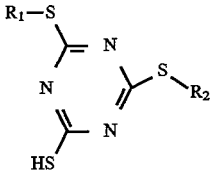

where $R_1$ and $R_2$ are the same or different and are selected from H or $C_1$ to $C_{12}$ branched or straight chain alkyl.

11. The turbo oil composition of claim 7 wherein the substituted trithiocyanuric acid is of the structural formula:

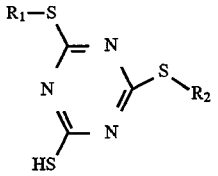

where $R_1$ and $R_2$ are the same or different and are selected from H or $C_1$ to $C_{12}$ branched or straight chain alkyl.

* * * * *